US006659096B1

(12) United States Patent
Nealy, Sr. et al.

(10) Patent No.: US 6,659,096 B1
(45) Date of Patent: Dec. 9, 2003

(54) SPLIT-BUSS-CABLE SINGLE-CAM COMPOUND ARCHERY BOW

(76) Inventors: Thomas R. Nealy, Sr., Winner's Choice Custom Bowstrings Inc., 141 E. Main St., John Day, OR (US) 97845; Michael D. Slinkard, Winner's Choice Custom Bowstrings Inc., 141 E. Main St., John Day, OR (US) 97845

( * ) Notice: Subject to any disclaimer, the term of this patent is extended or adjusted under 35 U.S.C. 154(b) by 1 day.

(21) Appl. No.: 10/052,483

(22) Filed: Jan. 18, 2002

(51) Int. Cl.[7] ..... F41B 5/10
(52) U.S. Cl. ..... 124/25.6
(58) Field of Search ..... 124/25.6, 86, 900

(56) References Cited

U.S. PATENT DOCUMENTS 4,300,521 A * 11/1981 Schmitt
4,440,142 A * 4/1984 Simonds
4,733,648 A * 3/1988 Martin ..... 124/86
4,781,167 A * 11/1988 Martin
4,909,231 A * 3/1990 Larson
5,307,787 A * 5/1994 LaBorde et al. ..... 124/25.6
5,381,777 A * 1/1995 Mitchell et al. ..... 124/25.6
5,623,915 A 4/1997 Kudlacek

* cited by examiner

*Primary Examiner*—John A. Ricci
(74) *Attorney, Agent, or Firm*—David S. Alavi

(57) ABSTRACT

A split-buss-cable single-cam compound archery bow substantially reduces torque exerted on the bow by the buss cable as the bow is drawn. An adjustable-width and adjustable-position splitter holds split buss cable ends in a substantially parallel spaced-apart configuration. The splitter is adapted to enable attachment at varying positions along the split buss cable and to enable adjustment of the splitter distance. The splitter may be positioned so as to substantially eliminate interference between the split buss cable and an archer's arm as the bow is drawn and released.

20 Claims, 6 Drawing Sheets

SPLIT-BUSS-CABLE SINGLE-CAM COMPOUND ARCHERY BOW

FIELD OF THE INVENTION

The field of the present invention relates to archery bows. In particular, a split-buss-cable single-cam archery bow is described herein including a splitter adjustable in position and width.

BACKGROUND

Solo or single-cam compound bows are well known in the art. A plurality of these have been previously disclosed, some of which are described in U.S. Pat. Nos. 5,505,185, 5,368,006, 5,975,067, and 6,098,607, each of said patents being incorporated by reference as if fully set forth herein. Dual-cam compound bows are also well known in the art, some of which are described in U.S. Pat. Nos. 4,739,744 and 5,040,520, each of said patents being incorporated by reference as if fully set forth herein. In these prior patents are described in detail the mechanics of a compound bow including non-circular single or dual cam members which impart dynamic forces on the bow limbs.

Whether single-cam or dual-cam, the purposes and advantages of compound bows are well known to those skilled in the art and need not be repeated herein. Compound bows typically comprise: a handle from which resilient bow limbs extend oppositely; pulley means comprising cams, levers, and/or pulleys and typically being disposed at the tips of the limbs of the bow; and one or more cables coupled to the bow limbs and/or pulley means to give assorted mechanical advantages. One important characteristic of compound bows is the "let-off" (i.e., an abrupt decrease) of the draw force at the end of the draw, thereby allowing an archer to more readily maintain the bow in a fully drawn position while accurately aiming the arrow and/or waiting for game to pass within shot.

A prior single-cam archery bow 1 is shown in FIGS. 1 and 2. Upper and lower bow limbs 11*a* and 11*b* are shown extending from central handle portion 10 and terminating at limb tips 12*a* and 12*b*. Each limb tip is divided to accommodate a pulley assembly 20/30 and is provided with an axle for rotatably mounting each pulley assembly thereon. In a typical single cam bow, one pulley assembly (pulley assembly 20 in this example) comprises a substantially circular idler wheel substantially concentrically mounted on the corresponding axle. The other pulley assembly (pulley assembly 30 in this example) typically includes multiple cams, pulleys, and/or levers and is eccentrically mounted on the corresponding axle. A draw cable 40 is secured to pulley assembly 30 and passes around pulley assembly 20, continuing as cable 41 (sometimes referred to as a let-out/take-up cable). Cable 41 is secured to pulley assembly 30. A buss cable 45 (also referred to as a power cable) is secured to the axle of pulley assembly 20 and to pulley assembly 30. As the bow is drawn, draw cable 40 is let out by pulley assembly 30, while cable 41 is let out by pulley assembly 30 and passes around pulley assembly 20. Buss cable 45 is taken up by pulley assembly 30. The lengths of the cables and size, shape, and configuration of pulley assembly 30 determines the force vs. draw distance characteristics of the bow.

Bow 1 may typically be provided with a cable guard 50 and cable guard slide 52. Cable 41 and buss cable 45 may pass through cable guard slide 52, which in turn slides along cable guard 50. The cable guard and slide serve to pull cables 41 and 45 laterally out of a draw/flight path of the arrow. An undesirable effect of cable guard 50 and slide 52 is the torque exerted on the pulley assemblies and bow limbs due to the lateral displacement of the cables, and the additional stress and wear on the cables themselves. These may degrade the accuracy and velocity of the bow, and may increase the frequency of string failure and replacement. One solution to this problem for a dual-cam compound bow is illustrated in U.S. Pat. No. 5,623,915 (hereinafter, "Kudlacek"), said patent being incorporated by reference as if fully set forth herein. The buss cables (two in the case of a dual-cam bow) are split after leaving the pulley assembly and the two split ends are secured to the two ends of the axle of the other pulley assembly (see FIGS. 1 and 2 of Kudlacek). A "splitter" holds apart the two split ends of the cable, preferably in a substantially parallel arrangement. The arrow may pass unimpeded between the split portions of the buss cables, and the substantially parallel arrangement and substantially symmetric attachment of the split ends to the axle substantially eliminates torque exerted on the bow by the buss cables as the bow is drawn. The location of the splitter is typically fixed along the length of the buss cables, and the width of the split buss cables often results in interference between the buss cables and the archer's arm as the bow is drawn and released.

It is desirable to provide a split buss cable and splitter adapted for use with a single-cam compound bow. It is desirable to provide a splitter that may be readily moved along the length of the buss cable and secured at varying locations thereof. It is desirable to provide a splitter having an adjustable width enabling its use with a variety of compound bows and bowstrings. It is desirable to position the splitter along the length of the buss cable so as to reduce interference between the buss cable and an archer's arm as the bow is drawn and released.

SUMMARY

Certain aspects of the present invention may overcome one or more aforementioned drawbacks of the previous art and/or advance the state-of-the-art of compound archery bows, and in addition may meet one or more of the following objects:

- To provide a single-cam compound archery bow including a split-buss-cable;
- To provide a single-cam compound archery bow including a split-buss-cable for reducing torque on the bow as it is drawn;
- To provide a single-cam compound archery bow including a split-buss-cable for improving the accuracy and/or velocity of the bow;
- To provide a single-cam compound archery bow including a split-buss-cable for reducing stress and wear on the buss cable;
- To provide a single-cam compound archery bow including a split-buss-cable and an adjustable-width splitter;
- To provide a single-cam compound archery bow including a split-buss-cable and an adjustable-position splitter;
- To provide a single-cam compound archery bow including a split-buss-cable and a splitter positioned so as to reduce interference between the split buss cable and an archer's arm;
- To provide an adjustable-width splitter for a split-buss-cable compound bow;
- To provide a splitter than that may be used for a variety of different compound bows;

To provide an adjustable-position splitter for a split-buss-cable compound bow;

To provide a splitter for a split-buss-cable compound bow that may be positioned so as to reduce interference between the split buss cable and an archer's arm;

To provide a splitter for a split-buss-cable compound bow that does not require any splitter component to be tied directly into the buss cable;

To provide a splitter and a pre-stretched split buss cable for a compound bow, thereby reducing movement and/or misalignment of the splitter as the bow is used; and To provide a splitter for a split-buss-cable compound bow that is adapted for tethering a fall-away arrow rest thereto.

One or more of the foregoing objects may be achieved in the present invention by a compound archery bow, comprising: a central handle portion; a first flexible bow limb and a second flexible bow limb terminating in first and second bow limb tips, respectively; a substantially circular pulley wheel rotatably mounted at the first bow limb tip; a cam assembly rotatably mounted eccentrically at the second bow limb tip; a draw cable secured to the cam assembly and passing around the pulley wheel; a let-out/take-up cable secured to the cam assembly and passing around the pulley wheel; a split buss cable having a first end secured to the cam assembly and a second end bifurcated into first and second split buss cable ends, each being secured at the first bow limb tip in a substantially bilaterally symmetric configuration; and a buss cable splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn.

One or more of the foregoing objects may be achieved in the present invention by a buss cable splitter, comprising: a first cable clamp adapted for securing the splitter to a first split cable end of a split buss cable; a second cable clamp adapted for securing the splitter to a second split cable end of the split buss cable; and a substantially rigid central member connected to the first and second cable clamps, the central member being adapted for holding in a spaced-apart configuration the first and second split cable ends of the split buss cable when said first and second split buss cable ends are clamped within the first and second cable clamps, respectively. The clamps may each include a main clamp member secured to the central member and a secondary clamp member urged toward and secured to the main clamp member by a clamp fastener, with the split buss cable ends being clamped between the corresponding main clamp members and secondary clamp members. The length of the splitter, and hence a splitter distance, may be adjustable, preferably by providing the splitter including multiple threadedly engaged members.

The split buss cable reduces torque on the bow and stress and wear on the buss cable, and may increase the accuracy and/or velocity of the compound bow. The clamping arrangement of the splitter enables a variety of placements along the length of the split buss cable ends, and eliminates the need for directly tying the splitter into the buss cable, facilitating later adjustment of the splitter position. The splitter may also be positioned so as to reduce or eliminate interference between a split cable end and an archer's arm. Adjustable width of the splitter enables adjustment to achieve substantially parallel arrangement of the split buss cable ends, and use of the splitter with any of a variety of different compound bow types.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

Figure 1:
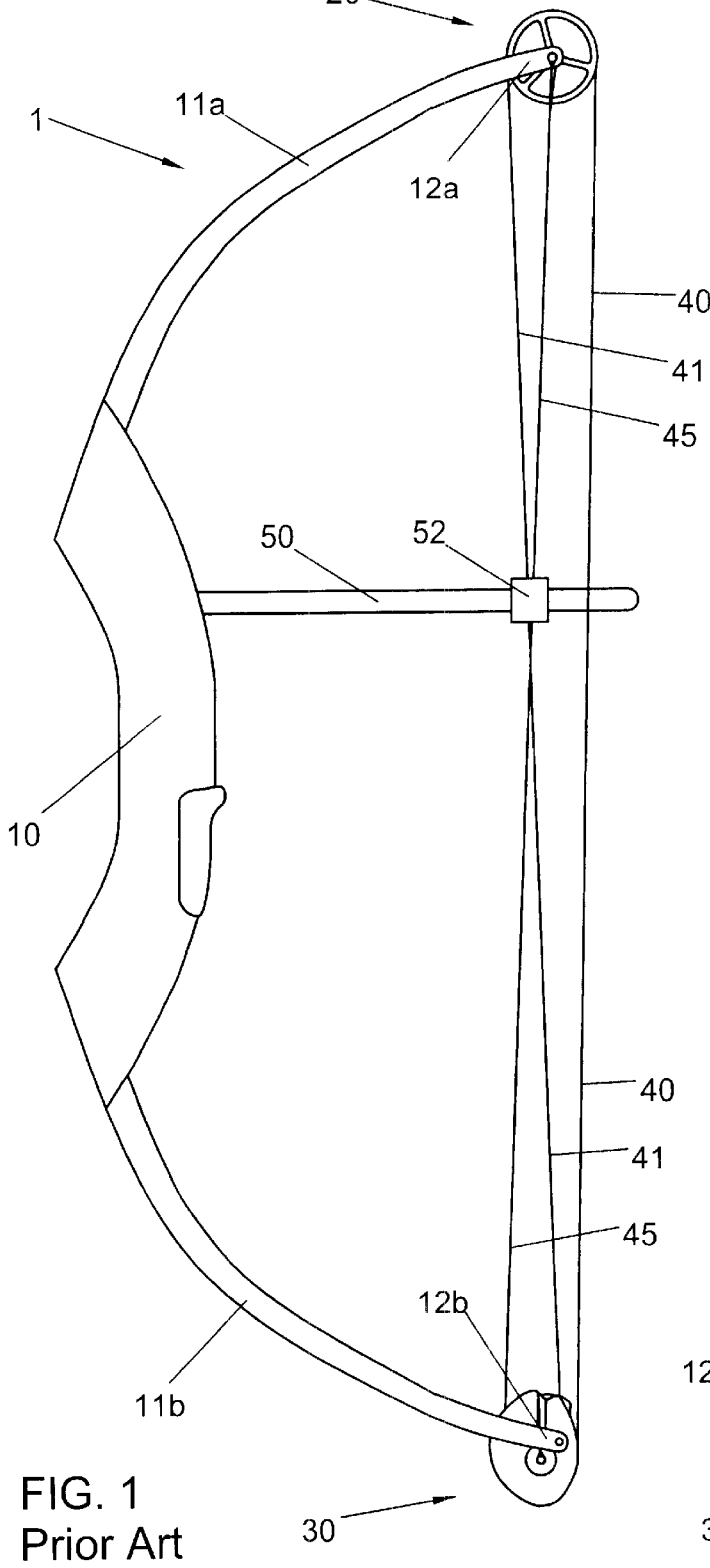
FIG. 1 Prior Art
FIGS. 1 and 2 are side and back views, respectively, of a prior single-cam compound archery bow.
Figure 2:
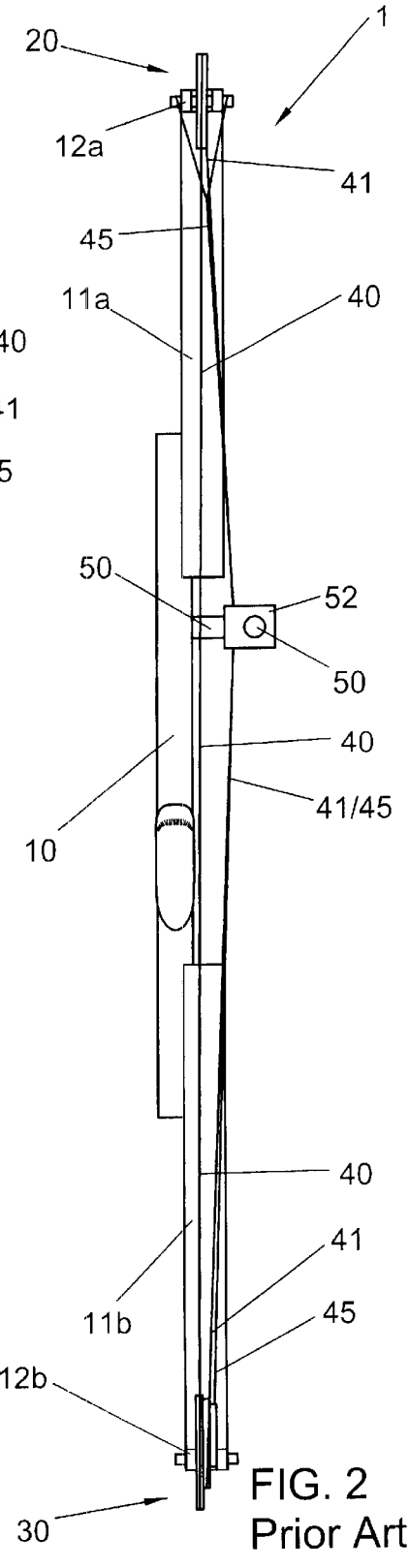
FIG. 2 Prior Art
Figure 3:
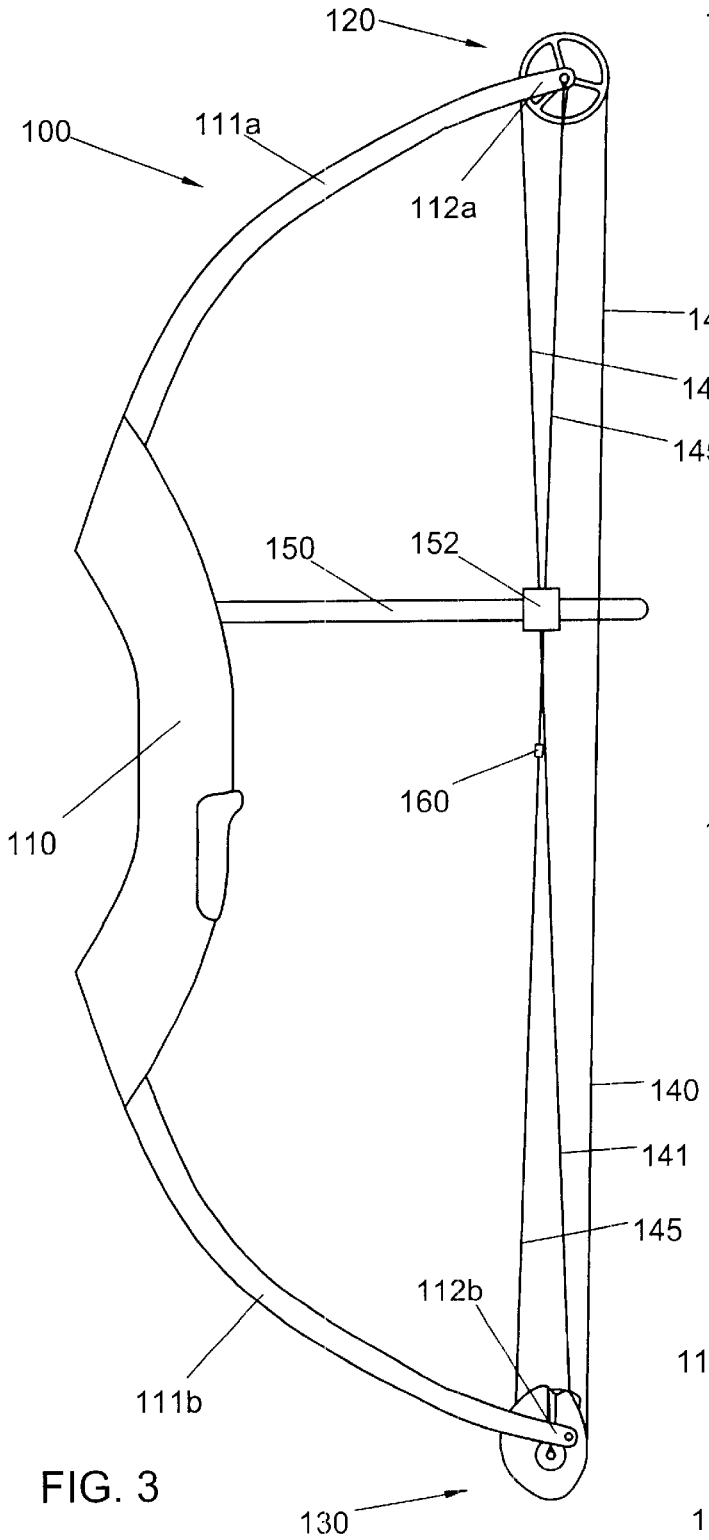
FIGS. 3 and 4 are side and back views, respectively, of a single-cam compound archery bow according to the present invention.
Figure 4:
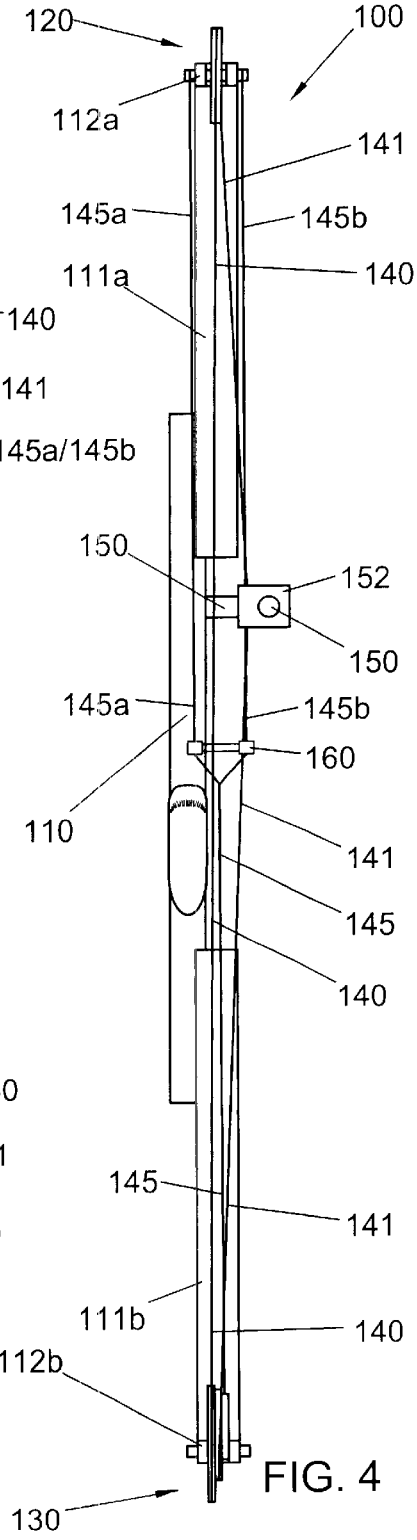

FIGS. 3 and 4 show an exemplary embodiment of a single-cam compound archery bow 100 according to the present invention. Upper and lower bow limbs 111*a* and 111*b* are shown extending from central handle portion 110 and terminating at limb tips 112*a* and 112*b*. Each limb tip is divided to accommodate a pulley assembly 120/130 and is provided with an axle for rotatably mounting each pulley assembly thereon. In this example of a single cam bow, one pulley assembly (pulley assembly 120 in this example) comprises a substantially circular idler wheel substantially concentrically mounted on the corresponding axle. The other pulley assembly (pulley assembly 130 in this example) may include multiple cams, pulleys, and/or levers and is eccentrically mounted on the corresponding axle. In the exemplary embodiment of FIGS. 3 and 4, pulley assembly 130 includes three eccentrically mounted cams. A draw cable 140 is secured to pulley assembly 130 and passes around pulley assembly 120, continuing as cable 141 (also referred to as a let-out/take-up cable). Cable 141 is secured to pulley assembly 130. A buss cable 145 (also referred to as a power cable) is secured to pulley assembly 130 at a first end, and splits into split buss cable ends 145*a* and 145*b* at the second end. Split buss cable ends 145*a* and 145*b* are secured to the axle of pulley assembly 120 on opposite sides of bow limb tip 112*a*. A substantially rigid buss cable splitter 160 is secured to split buss cable ends 145*a* and 145*b* and employed to hold split buss cable ends 145*a* and 145*b* in a spaced-apart configuration. A cable guard 150 and cable guard slide 152 serve to pull cable 141 laterally out of the flight path of an arrow, with cable 141 passing through cable guard slide 152 and cable guard slide 152 sliding along cable guard 150. One split buss cable end 145*b* may also pass through cable guard slide 152, and preferably freely slides therethrough with little or no lateral displacement. The cable guard and slide serve to pull cable 141 laterally out of the flight path of an arrow. As the bow is drawn, draw cable 140 is let out by pulley assembly 30, while cable 141 is let out by pulley assembly 130 and passes around pulley assembly 120. Buss cable 145 is taken up by pulley assembly 130. The lengths of the cables and size, shape, and configuration of pulley assembly 30 determines the force vs. draw distance characteristics of the bow, and may vary widely while remaining within the scope of inventive concepts disclosed and/or claimed herein.

The split arrangement of buss cable 145 and split buss cable ends 145*a* and 145*b* serve to keep the buss cable out of a flight path of an arrow, without undesirable torque being exerted on bow limb 111*a*. This is achieved in part by securing the split buss cable ends 145*a* and 145*b* at opposite sides of bow limb tip 112*a* and pulley assembly 120. Split buss cable ends 145*a* and 145*b* may preferably terminate in looped ends placed around opposite ends of an axle supporting pulley assembly 120. Other suitable arrangements may be equivalently employed for securing the split buss cable ends, either directly or indirectly, to bow limb tip 112*a*. This substantially symmetric attachment of spit buss cable ends 145*a* and 145*b* results in substantially reduced torque exerted on the bow as it is drawn, compared to bows having a non-split buss cable pulled to the side by the cable guard/slide. By making the first end (i.e., the non-split portion) of buss cable 145 sufficiently long, the splitter 160 and split buss cable end 145*a* may be positioned so as to substantially eliminate interference with the archer's arm as he/she draws and/or releases the bow. Splitter 160 is shown above a grip portion of central handle 110 in the exemplary embodiment of FIGS. 3 and 4. Preferably, the splitter position is chosen so that at substantially full draw of the bow the splitter does not reach the arm of the archer. Splitter 160 may preferably be constructed to enable removing and re-securing the splitter at varying positions along split buss cable ends 145*a* and 145*b*. In this way various cable geometries may be employed for adjusting the performance of the compound bow. In previous splitter designs (for dual-cam compound bows), the splitter, or attachment hardware therefor, is tied directly into the split buss cable ends, thereby fixing the position of the splitter and preventing any subsequent adjustment of the compound bow.

To further reduce torque on the bow 100 as it is drawn, split buss cable ends 145*a* and 145*b* are preferably substantially parallel when held in a spaced-apart configuration by splitter 160. A different splitter 160 may therefore be designed for each different compound bow so that the splitter width (alternatively, splitter distance) substantially matches the width of the attachments of split buss cable ends at the bow limb tip. Alternatively, the splitter may preferably be constructed so as to enable adjustment of the splitter distance. In this way, a single adjustable splitter may be used with a variety of compound bows having various widths for the attachment of the split buss cable ends.

Figure 5A:
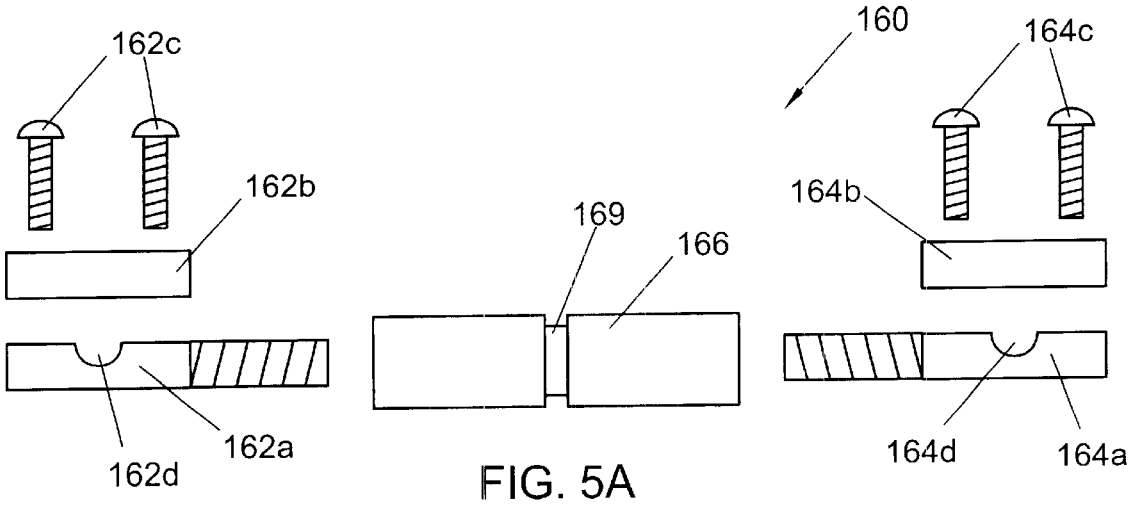
FIGS. 5A, 5B, and 5C are top exploded, top assembled, and front assembled views, respectively, of a splitter according to the present invention.

A preferred embodiment for a splitter is shown in FIGS. 5A (top, exploded), 5B (top, assembled), and 5C (front). The splitter includes first and second cable clamps secured to a central member 166. Each of the cable clamps preferably includes a main clamp member 162*a*/164*a* secured to the central member 166, and a secondary clamp member 162*b*/164*b* secured to the corresponding main clamp member 162*a*/164*a* by at least one clamp fastener 162*c*/164*c*. A split buss cable end may be clamped between a main clamp member and secondary clamp member urged together and secured together by clamp fastener(s). Threaded fasteners are shown, but any suitable fastener may be employed that enables removing and re-securing a split buss cable end between clamp members 162*a*/162*b* and /or 164*a*/164*b* while remaining within the scope of inventive concepts disclosed and/or claimed herein. Grooves 162*d*/164*d* may be provided for receiving the split buss cable ends 145*a*/145*b*. The clamp arrangement enables removing and re-securing of splitter 160 at varying points along the lengths of split buss cable ends 145*a* and 145*b*.

Main clamp members 162*a*/164*a* are shown threadedly engaged with central member 166, thereby securing main clamp members 162*a*/164*a* to central member 166. This threaded embodiment is preferred enabling adjustment of the splitter distance. Main clamp members 162*a*/164*a* may be threaded into central member 166 to varying degrees, thereby varying the splitter distance. The threads are preferably of opposite handedness for main clamp members 162*a*/a64*a* so that the splitter distance may be adjusted with the splitter already clamped onto the split buss cable ends. In an alternative embodiment, the threads may be of the same handedness, and adjustment of the splitter distance may be performed prior to clamping the splitter onto the split buss cable ends. In an alternative embodiment, central member 166 may be provided with one or more flat surfaces, one or more knurled surfaces, one or more holes, or other suitable structure(s) for facilitating adjustment of the splitter distance by hand or by using a wrench or other suitable tool. In an alternative embodiment, central member may be rigidly secured to one of main clamp members 162*a*/164*a* and threadedly engaged with the other. In an alternative embodiment, any other suitable mechanism for enabling adjustment of the splitter distance may be equivalently employed while remaining within the scope of inventive concepts disclosed and/or claimed herein.

Figure 5B:
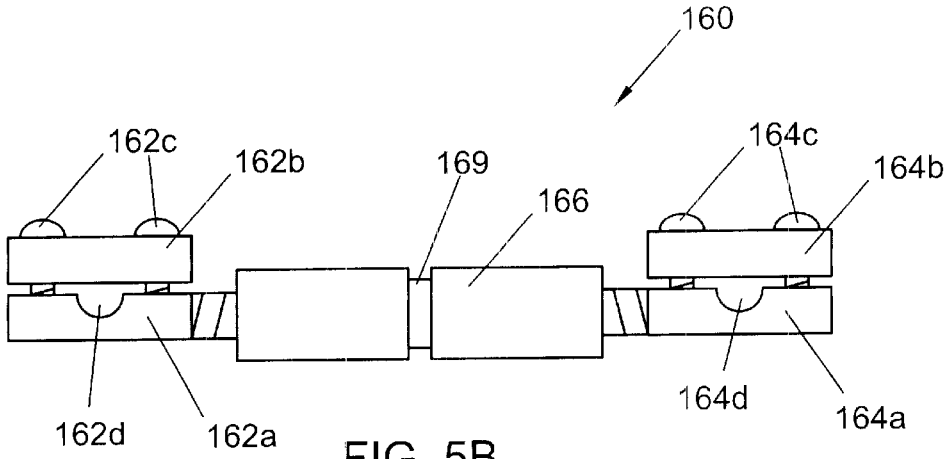
Figure 5C:
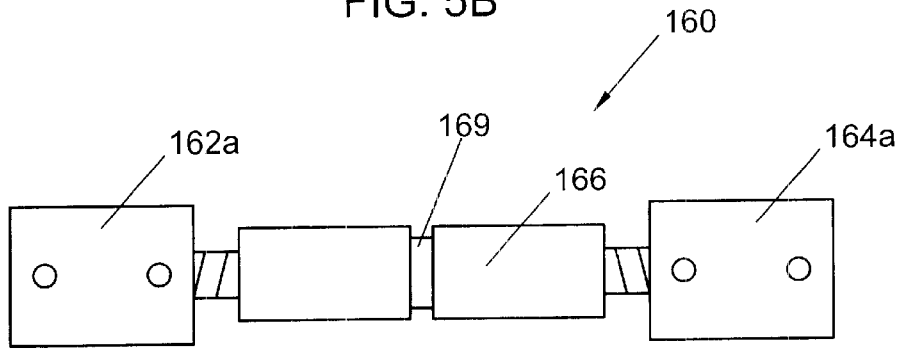
Figure 6A:
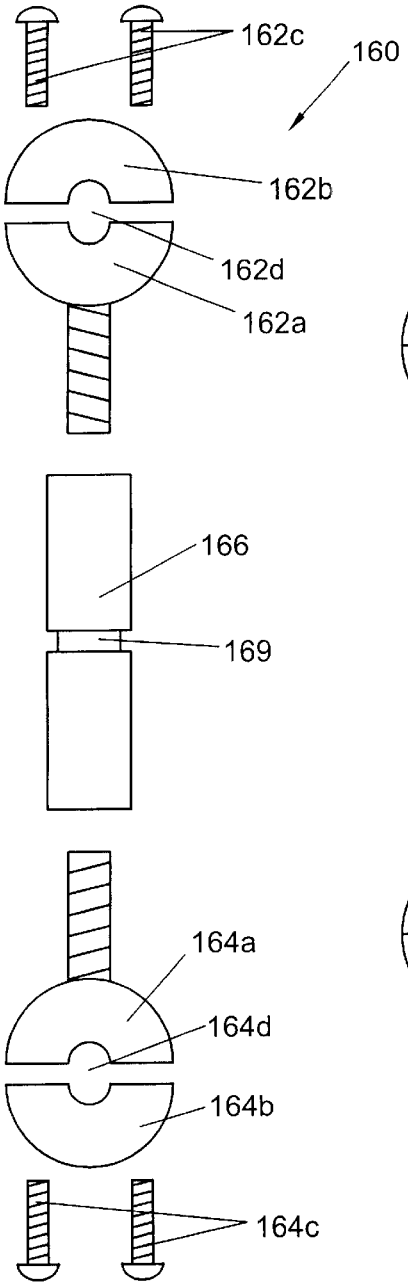
FIGS. 6A, 6B, and 6C are top exploded, top assembled, and front assembled views, respectively, of a splitter according to the present invention.
Figure 6B:
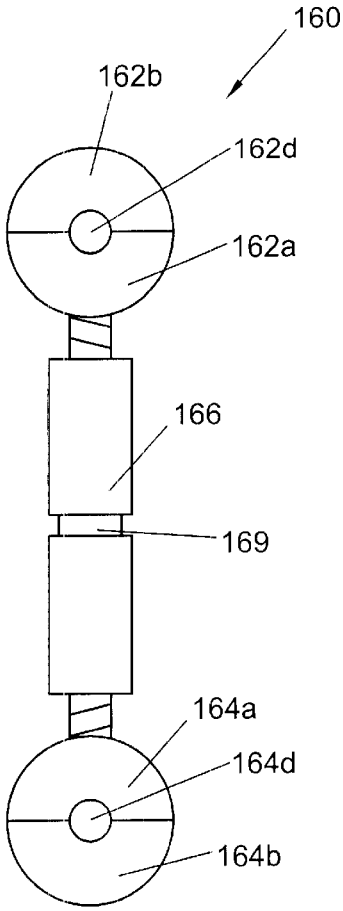
Figure 6C:
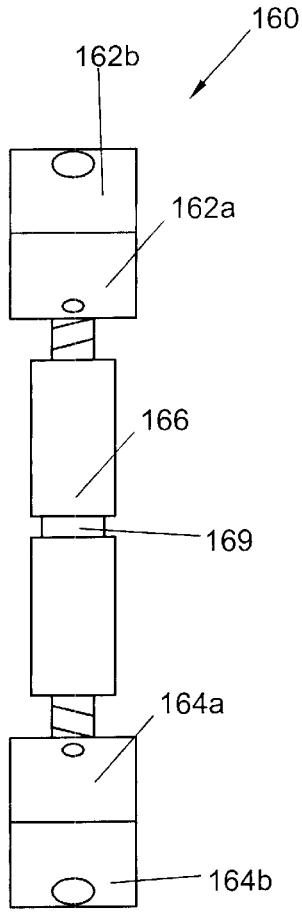
Figure 7A:
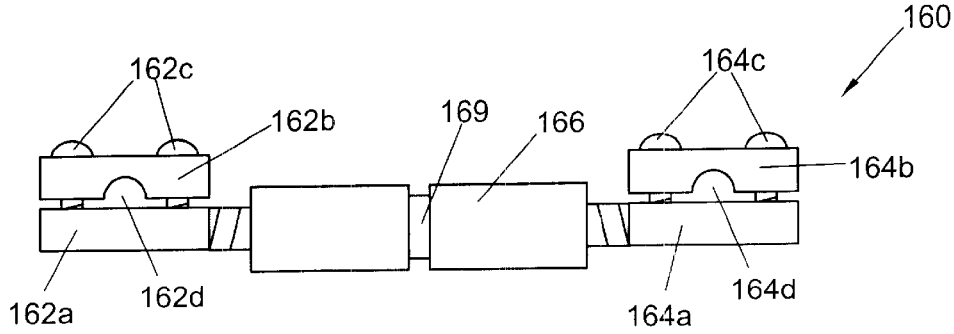
FIGS. 7A, 7B, 7C, and 7D are top views of alternative splitters according to the present invention.
Figure 7B:
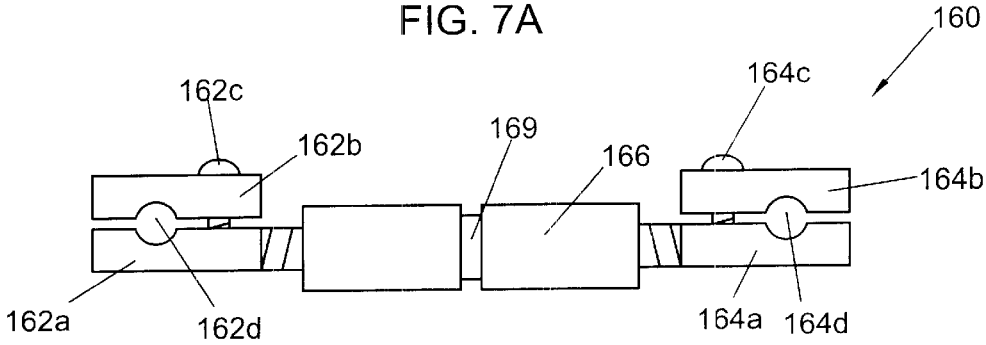
Figure 7C:
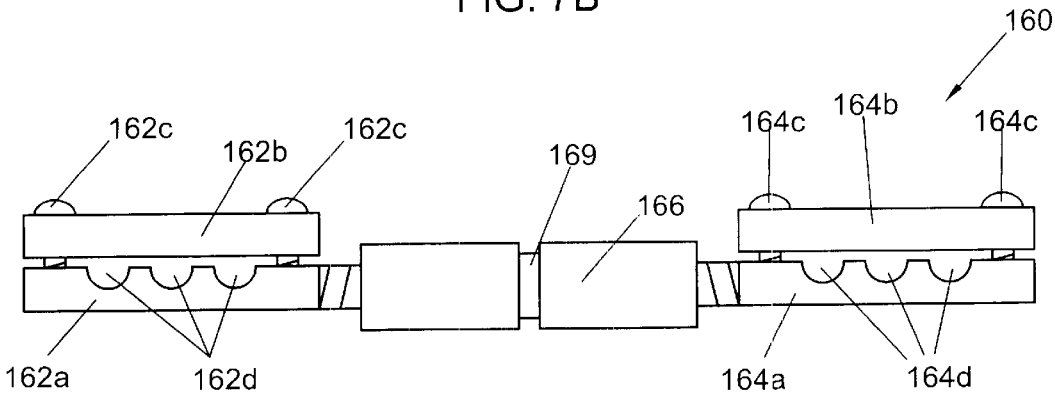
Figure 7D:
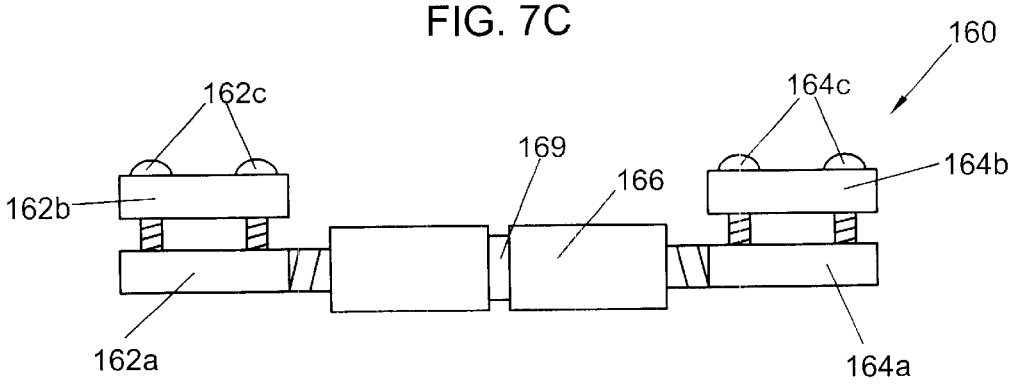

In the embodiment of FIGS. 5A, 5B, and 5C, fasteners 162*c* and 164*c* urge clamp members 162*a*/162*b* and 164*a*/164*b*, respectively, together in a direction substantially perpendicular to central member 166. In an alternative embodiment shown in FIGS. 6A. 6B, and 6C, clamp members are shown urged together by clam fasteners in a direction substantially parallel to central member 166. In the embodiment of FIGS. 5A, 5B, and 5C, grooves 162*d*/164*d* are shown provided on main clamp members 162*a*/164*a* for receiving the split buss cable-ends. Grooves 162*d*/162*d* may alternatively be provided on secondary clamp members 162*b*/164*b* (alternative embodiment of FIG. 7A), or on both main clamp members 162*a*/164*a* and secondary clamp members 162*b*/164*b* (alternative embodiments of FIGS. 6A, 6B, 6C, and 7B). In an alternative embodiment shown in FIG. 7D, no grooves are provided. In an alternative embodiment shown in FIG. 7C, multiple grooves may be provided, enabling coarse adjustment of the splitter distance through the choice of groove for receiving a split buss cable end. Multiple grooves are shown in main clamp members 162*a*/164*a*, but may alternatively be provided in secondary clamp members 162*b*/164*b*, or in both main and secondary clamp members. In the alternative embodiment of FIG. 7B, only one fastener 162*c*/164*c* is shown for each cable clamp. Use of a single fastener or multiple fasteners may be employed in various of the embodiments disclosed herein as desired.

Figure 8A:
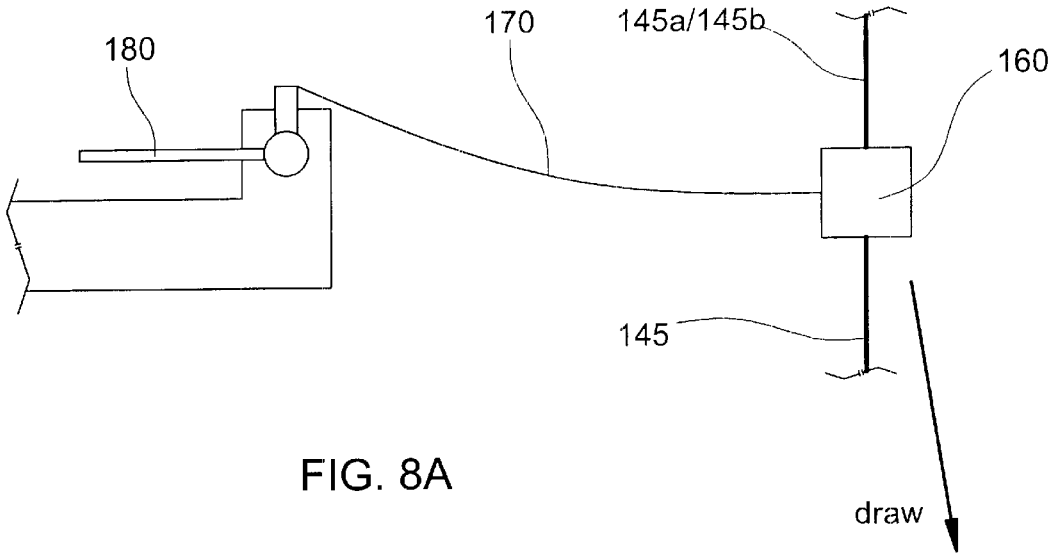
FIGS. 8A and 8B are side views of a splitter, tether, and fall-away arrow rest according to the present invention.
Figure 8B:
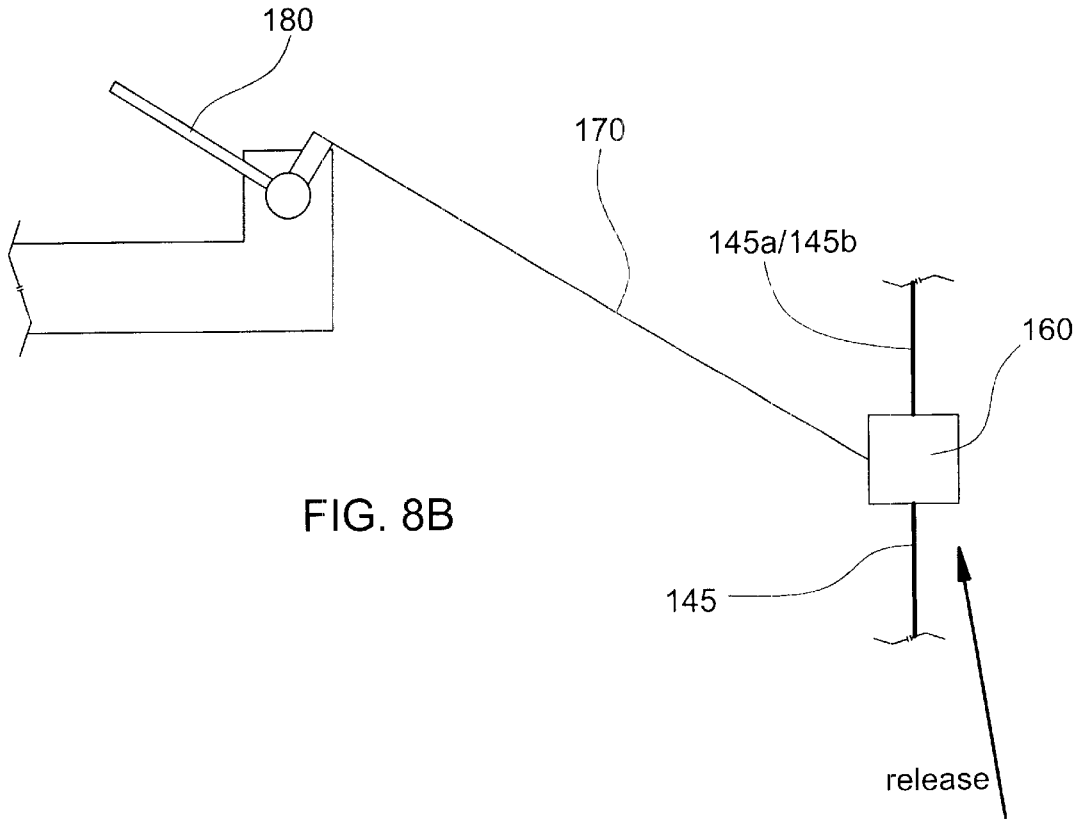

A groove or slot 169 may be provided on central member 166 for enabling attachment of a tether 170 for a fall-away arrow rest 180 (FIGS. 8A and 8B). Movement of the splitter during release of the arrow may therefore actuate the fall-away rest, allowing it to fall away from the arrow during the initial stage of the arrow's flight.

A split-buss-cable single-cam compound bow according to the present invention may preferably be constructed using pre-stretched cables. The use of pre-stretched cables reduces movement and/or mis-alignment of the splitter as the bow is repeatedly drawn and released during use.

It should be appreciated that an adjustable-width and/or adjustable-position splitter according to the present invention may be employed in constructing split-buss-cable dual-cam compound bows, in addition to the split-buss-cable single-cam compound bows of the present invention. Use of an adjustable-width and/or adjustable-position splitter in a dual-cam bow enables adjustment of cable configuration in a manner similar to that described hereinabove for a single-cam bow.

The present invention has been set forth in the forms of its preferred and alternative embodiments. These embodiments are illustrative and not intended to limit the scope of the claims set forth hereinbelow. It is intended that modifications to the disclosed split-buss-cable single-cam compound bow and/or adjustable-width/position splitter may be made without departing from inventive concepts disclosed and/or claimed herein.

What is claimed is:

1. A compound archery bow, comprising:

a central handle portion;

a first flexible bow limb and a second flexible bow limb, the first and second bow limbs being mounted on and projecting oppositely and substantially symmetrically from the handle and terminating in first and second bow limb tips, respectively;

a substantially circular pulley wheel, the pulley wheel being rotatably mounted substantially concentrically at the first bow limb tip:

a cam assembly, the cam assembly being rotatably mounted eccentrically at the second bow limb tip;

a draw cable, the draw cable being secured to the cam assembly and passing around the pulley wheel;

a let-out/take-up cable, the let-out/take-up cable being secured to the cam assembly, the let-out/take-up cable passing around the pulley wheel;

a split buss cable, the split buss cable having a first end and a second end, the first end being secured to the cam assembly, the second end being bifurcated into first and second split buss cable ends, the first and second split buss cable ends being secured at the first bow limb tip at opposing sides thereof; and a buss cable splitter, the splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn, the splitter being adapted for enabling removing and re-securing the splitter at varying points along the length of the first and second split buss cable ends.

2. The archery bow of claim 1, the splitter comprising:

a first cable clamp adapted for securing the splitter to the first split buss cable end;

a second cable clamp adapted for securing the splitter to the second split buss cable end; and a central member connected to the first and second cable clamps, the central member being adapted for holding in the spaced-apart configuration the first and second split buss cable ends when said first and second split buss cable ends are clamped within the first and second cable clamps, respectively.

3. The archery bow of claim 2, the first and second cable clamps each including a main clamp member secured to the central member and a secondary clamp member, the secondary clamp member being urged toward and secured to the main clamp member with a clamp fastener, the first and second cable clamps being thereby adapted for clamping a respective split buss cable end between the respective main clamp member and the secondary clamp member.

4. The archery bow of claim 3, the main clamp member and the secondary clamp member of each of the first and second cable clamps being urged together along a direction substantially parallel to the central member.

5. The archery bow of claim 3, the main clamp member and the secondary clamp member of each of the first and second cable clamps being urged together along a direction substantially perpendicular to the central member.

6. A compound archery bow, comprising:

a central handle portion;

a first flexible bow limb and a second flexible bow limb, the first and second bow limbs being mounted on and projecting oppositely and substantially symmetrically from the handle and terminating in first and second bow limb tips, respectively;

a substantially circular pulley wheel, the pulley wheel being rotatable mounted substantially concentrically at the first bow limb tip;

a cam assembly, the cam assembly being rotatable mounted eccentrically at the second bow limb tip;

a draw cable, the draw cable being secured to the cam assembly and passing around the pulley wheel;

a let-out/take-up cable, the let-out/take-up cable being secured to the cam assembly, the let-out/take-up cable passing around the pulley wheel;

a split buss cable, the split buss cable having a first end and a second end, the first end being secured to the cam assembly, the second end being bifurcated into first and second split buss cable ends, the first and second split buss cable ends being secured at the first bow limb tip at opposing sides thereof; and a buss cable splitter, the splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn, the splitter being positioned along the first and second split buss cable ends so as to substantially reduce interference between an archer's arm and one of the first and second split buss cable ends during at least one of drawing and releasing the bow by the archer.

7. The archery bow of claim 5, the splitter being positioned along the first and second split buss cable ends at a distance from the cam assembly sufficiently great so that at substantially full draw the splitter has not reached the arm of the archer.

8. A compound archery bow, comprising:

a central handle portion;

a first flexible bow limb and a second flexible bow limb, the first and second bow limbs being mounted on and projecting oppositely and substantially symmetrically from the handle and terminating in first and second bow limb tips, respectively;

a substantially circular pulley wheel, the pulley wheel being rotatable mounted substantially concentrically at the first bow limb tip;

a cam assembly, the cam assembly being rotatable mounted eccentrically at the second bow limb tip;

a draw cable, the draw cable being secured to the cam assembly and passing around the pulley wheel;

a let-out/take-up cable, the let-out/take-up cable being secured to the cam assembly, the let-out/take-up cable passing around the pulley wheel;

a split buss cable, the split buss cable having a first end and a second end, the first end being secured to the cam assembly, the second end being bifurcated into first and second split buss cable ends, the first and second split buss cable ends being secured at the first bow limb tip at opposing sides thereof; and a buss cable splitter, the splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn, the splitter being adapted for enabling adjustment of the splitter distance.

9. The archery bow of claim 8, the splitter including threadedly engaged members, the splitter being thereby adapted for enabling adjustment of the splitter distance.

10. A compound archery bow, comprising:

a central handle portion;

a first flexible bow limb and a second flexible bow limb, the first and second bow limbs being mounted on and projecting oppositely and substantially symmetrically from the handle and terminating in first and second bow limb tips, respectively;

a substantially circular pulley wheel, the pulley wheel being rotatably mounted substantially concentrically at the first bow limb tip;

a cam assembly, the cam assembly being rotatable mounted eccentrically at the second bow limb tip;

a draw cable, the draw cable being secured to the cam assembly and passing around the pulley wheel;

a let-out/take-up cable, the let-out/take-up cable being secured to the cam assembly, the let-out/take-up cable passing around the pulley wheel;

a split buss cable, the split buss cable having a first end and a second end, the first end being secured to the cam assembly, the second end being bifurcated into first and second split buss cable ends, the first and second split buss cable ends being secured at the first bow limb tip at opposing sides thereof; and a buss cable splitter, the splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn, the split buss cable being a pre-stretched cable, thereby reducing at least one of movement and mis-alignment of the splitter resulting from use of the bow.

11. A compound archery bow, comprising:

a central handle portion;

a first flexible bow limb and a second flexible bow limb, the first and second bow limbs being mounted on and projecting oppositely and substantially symmetrically from the handle and terminating in first and second bow limb tips, respectively;

a substantially circular pulley wheel, the pulley wheel being rotatable mounted substantially concentrically at the first bow limb tip;

a cam assembly, the cam assembly being rotatable mounted eccentrically at the second bow limb tip;

a draw cable, the draw cable being secured to the cam assembly and passing around the pulley wheel;

a let-out/take-up cable, the let-out/take-up cable being secured to the cam assembly, the let-out/take-up cable passing around the pulley wheel;

a split buss cable, the split buss cable having a first end and a second end, the first end being secured to the cam assembly, the second end being bifurcated into first and second split buss cable ends, the first and second split buss cable ends being secured at the first bow limb tip at opposing sides thereof; and a buss cable splitter, the splitter including a substantially rigid member secured to the first and second split buss cable ends so as to hold the first and second split buss cable ends in a spaced-apart configuration separated by a splitter distance, the cam assembly being adapted for letting out the draw cable as the bow is drawn, for letting out the let-out/take-up cable as the bow is drawn, and taking up the first end of the split buss cable as the bow is drawn, further including a fall-away arrow rest and a tether connecting the splitter and the arrow rest, the splitter being adapted for connecting the tether thereto, the tether being adapted for allowing the fall-away arrow rest to fall away upon release of the arrow.

12. A buss cable splitter for a compound archery bow, comprising:

a first cable clamp adapted for securing the splitter to a first split cable end of a split buss cable;

a second cable clamp adapted for securing the splitter to a second split cable end of the split buss cable; and a substantially rigid central member connected to the first and second cable clamps, the central member being adapted for holding in a spaced-apart configuration the first and second split cable ends of the split buss cable when said first and second split buss cable ends are clamped within the first and second cable clamps, respectively.

13. The buss cable splitter of claim 12, the splitter being adapted for enabling removing and re-securing the splitter at varying points along the length of the first and second split cable ends of the split buss cable.

14. The buss cable splitter of claim 13, the first and second cable clamps each including a main clamp member secured to the central member and a secondary clamp member, the secondary clamp member being urged toward and secured to the main clamp member with a clamp fastener, the first and second cable clamps being thereby adapted for clamping a respective split buss cable end between the respective main clamp member and the secondary clamp member.

15. The buss cable splitter of claim 14, the main clamp member and the secondary clamp member of each of the first and second cable clamps being urged together along a direction substantially parallel to the central member.

16. The buss cable splitter of claim 14, the main clamp member and the secondary clamp member of each of the first and second cable clamps being urged together along a direction substantially perpendicular to the central member.

17. The buss cable splitter of claim 12, the splitter being adapted for enabling adjustment of the splitter distance.

18. The buss cable splitter of claim 17, the central member comprising at least two members threadedly engaged together, the central member being thereby adapted for enabling adjustment of the splitter distance.

19. The buss cable splitter of claim 17, the splitter being adapted for use with any one of a variety of different compound bow types.

20. The buss cable splitter of claim 12, he splitter being adapted for being tethered to a fall-away arrow rest.

* * * * *